US011256203B2

(12) United States Patent
Ikeno

(10) Patent No.: US 11,256,203 B2
(45) Date of Patent: Feb. 22, 2022

(54) FUSER HAVING A BASE PLATE WITH ROUNDED EDGES IN A HEATER

(71) Applicant: Brother Kogyo Kabushiki Kaisha, Nagoya (JP)

(72) Inventor: Yuichi Ikeno, Maibara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/190,738

(22) Filed: Mar. 3, 2021

(65) Prior Publication Data

US 2021/0286296 A1 Sep. 16, 2021

(30) Foreign Application Priority Data

Mar. 10, 2020 (JP) ..... JP2020-040646

(51) Int. Cl.
*G03G 15/20* (2006.01)

(52) U.S. Cl.
CPC ..... *G03G 15/2053* (2013.01); *G03G 15/2028* (2013.01); *G03G 15/2057* (2013.01); *G03G 2215/2025* (2013.01); *G03G 2215/2035* (2013.01)

(58) Field of Classification Search
CPC ..... G03G 15/2053; G03G 15/2017; G03G 2215/2035
USPC ..... 399/329
See application file for complete search history.

(56) References Cited

U.S. PATENT DOCUMENTS

| | | | | |
|---|---|---|---|---|
| 6,583,389 | B2 * | 6/2003 | Murooka | G03G 15/2064 118/60 |
| 2003/0035667 | A1 * | 2/2003 | Izawa | G03G 15/2053 399/333 |
| 2015/0277309 | A1 | 10/2015 | Kuroda | |
| 2017/0176907 | A1 * | 6/2017 | Sawada | G03G 15/2028 |
| 2017/0261899 | A1 * | 9/2017 | Gotoh | G03G 15/2053 |
| 2020/0004182 | A1 * | 1/2020 | Yabuki | G03G 15/2064 |
| 2021/0103239 | A1 * | 4/2021 | Miyata | G03G 15/2064 |

FOREIGN PATENT DOCUMENTS

| | | | |
|---|---|---|---|
| JP | H05-134570 A | | 5/1993 |
| JP | H10-133502 A | | 5/1998 |
| JP | 2001222180 A | * | 8/2001 |
| JP | 2004-093 842 A | | 3/2004 |
| JP | 2015-191734 A | | 11/2015 |

* cited by examiner

*Primary Examiner* — Robert B Beatty
(74) *Attorney, Agent, or Firm* — Burr & Brown, PLLC

(57) ABSTRACT

A fuser having a heater, a belt, and a holder, is provided. The heater includes a metal-made base plate and a resistive-heating element and has a first face and a second face. The resistive-heating element is formed on at least one of the first face and the second face. The belt being an endless belt has an inner circumferential surface contacting the first face of the heater and rotates around the heater. The holder has a retainer face to contact the second face of the heater to retain the heater and a belt-guiding face to contact the inner circumferential surface of the belt and guide the belt therealong. The base plate has a pair of first edges located on one end and the other end of the first face in the widthwise direction extending in the lengthwise direction. The pair of first edges are rounded at ridges.

13 Claims, 6 Drawing Sheets

FUSER HAVING A BASE PLATE WITH ROUNDED EDGES IN A HEATER

CROSS REFERENCE TO RELATED APPLICATION

This application claims priority from Japanese Patent Application No. 2020-040646, filed on Mar. 10, 2020, the entire subject matter of which is incorporated herein by reference.

BACKGROUND

Technical Field

An aspect of the present disclosure is related to a fuser.

Related Art

A fuser having, for example, a ceramic heater, a fusing belt, and a heater holder, is known. The fusing belt may be an endless belt and have an inner circumferential surface that contacts the ceramic heater. The heater holder may retain the ceramic heater and contact the inner circumferential surface of the fusing belt to guide the fusing belt there-along. The fusing belt may be heated by the ceramic heater and rotate around the ceramic heater so that a recording medium having an image thereon may be heated through the fusing belt.

SUMMARY

For another example, a heater having a metal-made base plate may be employed in a fuser. The base plate may be manufactured in pressing or shearing works and may have a shear drop on an edge on one side and a burr or a sharpened edge on the other side thereof. The sharpened edges and the burrs on the edges of the base plate may damage the inner circumferential surface of the fusing belt; therefore, with the sharpened edges and burrs, it may be difficult to improve durability of the fusing belt.

The present disclosure is advantageous in that a fuser, in which durability of the belt may be improved, is provided.

According to an aspect of the present disclosure, a fuser having a heater, a belt, and a holder, is provided. The heater includes a metal-made base plate and a resistive-heating element. The heater has a first face extending in a lengthwise direction and a widthwise direction and a second face facing reversely from the first face. The resistive-heating element is formed on at least one of the first face and the second face. The belt being an endless belt has an inner circumferential surface. The inner circumferential surface is in contact with the first face of the heater. The belt is configured to rotate around the heater. The holder has a retainer face configured to contact the second face of the heater to retain the heater and a belt-guiding face configured to contact the inner circumferential surface of the belt and guide the belt there-along. The base plate has a pair of first edges located on one end and the other end of the first face in the widthwise direction. The pair of first edges are rounded at ridges extending in the lengthwise direction.

BRIEF DESCRIPTION OF THE ACCOMPANYING DRAWINGS

DETAILED DESCRIPTION

Hereinafter, first through third embodiments of the present disclosure will be described with reference to the accompanying drawings.

First Embodiment

Figure 1:
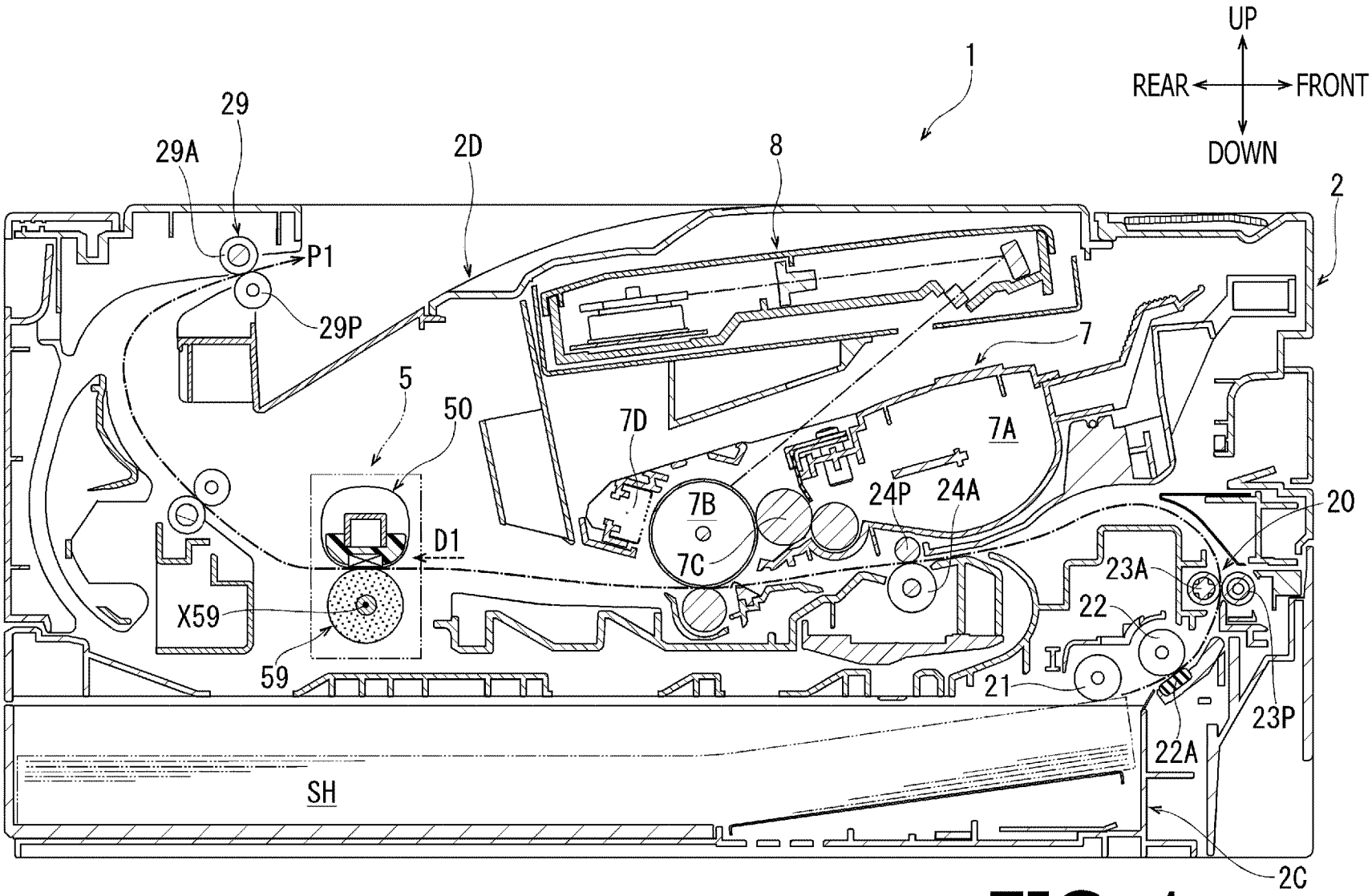
FIG. 1 is an illustrative cross-sectional view of an image forming apparatus having a fuser according to a first embodiment of the present disclosure.

As shown in FIG. 1, a fuser 5 in the first embodiment is provided in an image forming apparatus 1. The image forming apparatus 1 may be a laser printer capable of forming an image on a sheet SH electro-photographically. In the following paragraphs, an overall configuration of components in the image forming apparatus 1 will be described with reference to FIG. 1, and later the fuser 5 will be described in detail.

<Overall Configuration of the Image Forming Apparatus>

As shown in FIG. 1, the image forming apparatus 1 includes a main body 2, a feeder 20, a process cartridge 7, a scanner 8, a fuser 5, and an ejection device 29.

The main body 2 may include a casing and frames which are not shown in the drawings. At a lower position in the main body 2, a sheet cassette 2C may be detachably attached. In the sheet cassette 2C, sheets SH, on which images may be formed, may be stacked. The sheets SH may be, for example, paper sheets or OHP sheets.

The main body 2 has an ejection tray 2D formed on a top face thereof. On the ejection tray 2D, the sheets SH with the images formed thereon being ejected outside the casing may be placed. At a frontward area in the main body 2, the feeder 20 is arranged. The feeder 20 may convey the sheets SH stored in the sheet cassette 2C to the process cartridge 7. At a rearward area in the main body 2, the fuser 5 is arranged. The fuser 5 may apply heat and pressure to the sheet SH conveyed through the process cartridge 7.

Inside the main body 2, a conveyer path P1 is formed. The conveyer path P1 is a path extending upward from a frontward end of the sheet cassette 2C and turning in a shape of U, extending rearward therefrom approximately horizontally, through the process cartridge 7 and the fuser 5, turning upward in another shape of U, and through the ejection device 29 to the ejection tray 2D.

The feeder 20 includes a feed roller 21, a separation roller 22, and a separation pad 22A, which may feed the sheets SH stored in the sheet cassette 2C to the conveyer path P1 one by one. The feeder 20 further includes a conveyer roller 23A and a pinch roller 23P; and a registration roller 24A and a pinch roller 24P; which are arranged along the conveyer path P1 to convey the sheets SH to the process cartridge 7.

The process cartridge 7 includes a developing agent container 7A, a photosensitive drum 7B, a developing roller 7C, and a charger 7D, which may be in a known configuration.

The scanner 8 is located at an upper position with respect to the process cartridge 7. The scanner 8 may include a laser-beam emitter, a polygon mirror, an fθ lens, and a reflection mirror, which may be in known configurations. The scanner 8 may emit a laser beam from the upper position at the photosensitive drum 7B in the process cartridge 7.

As the photosensitive drum 7B rotates, a surface of the photosensitive drum 7B may be positively charged evenly by the charger 7D and exposed to the scanning laser beam emitted from the scanner 8. Thereby, an electrostatic latent image, which corresponds to an image to be formed on the sheet SH, may be formed on the surface of the photosensitive drum 7B. The developing roller 7C may supply a developing agent from the developing agent container 7A to the electrostatic latent image. Thereby, an image may be formed in the developing agent on the surface of the photosensitive drum 7B. The image in the developing agent may be transferred onto the sheet SH being conveyed through the process cartridge 7.

The fuser 5 is located at a position rearward with respect to the process cartridge 7. The fuser 5 includes a heating unit 50, which is located on an upper side of the conveyer path P1, and a pressure roller 59, which is located on a lower side of the conveyer path P1 to face the heating unit 50 across the conveyer path P1. One of the heating unit 50 and the pressure roller 29 is urged against the other of the heating unit 50 and the pressure roller 29 by an urging device, which is not shown. The pressure roller 59 may rotate about a rotation axis X59. The fuser 5 may nip the sheet SH between the heating unit 50 and the pressure roller 59 to thermally fuse and fix the image in the developing agent onto the sheet SH.

The ejection device 29 includes an ejection roller 29A and an ejection-pinch roller 29P, which may eject the sheet SH with the image formed in the developing agent and fixed thereon at the ejection tray 2D.

<Detailed Configuration of the Fuser>

Figure 2:
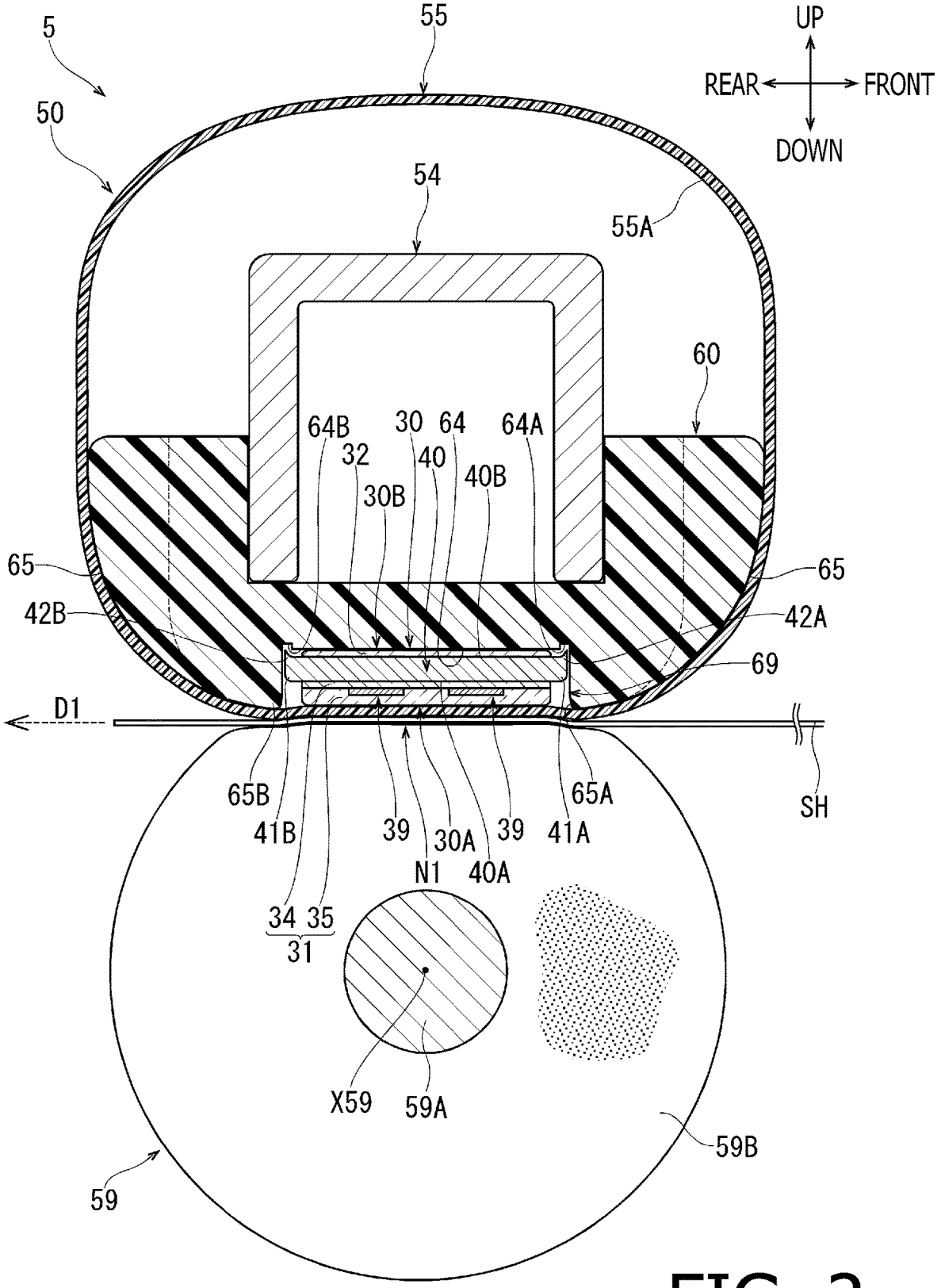
FIG. 2 is an illustrative cross-sectional view of the fuser according to the first embodiment of the present disclosure.
Figure 3:
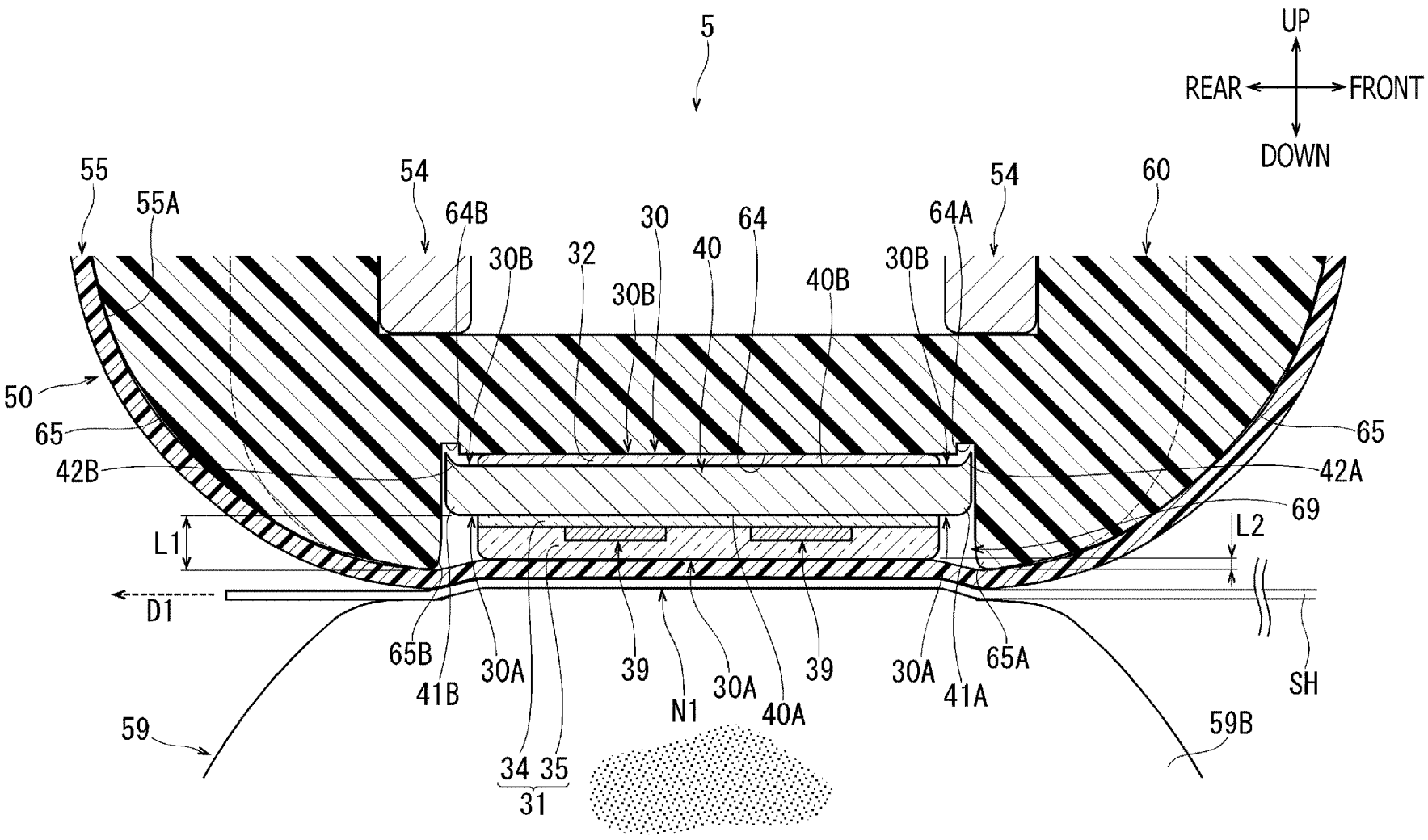
FIG. 3 is a cross-sectional partial view of the fuser according to the first embodiment of the present disclosure.

As shown in FIGS. 2 and 3, the heating unit 50 in the fuser 5 includes a heater 30, a belt 55, a stay 54, and a holder 60.

The heater 30 has a form of an approximately rectangular plate, which has a first face 30A and a second face 30B. The first face 30A faces downward and extends in a conveying direction D1, which is a direction to convey the sheet SH in the fuser 5, and in the rotation axis X59 of the heat roller 59, which is parallel to a crosswise direction of the sheet SH conveyed in the fuser 5. In other words, the first face 30A is arranged to lie above and along the sheet SH being conveyed in the fuser 5. The second face 30B faces reversely from the first face 30A, i.e., upward.

In the following paragraphs, the direction of the rotation axis X59 of the pressure roller 59 may be called as a lengthwise direction, and the conveying direction D1, in which the sheet SH is conveyed in the fuser 5, may be called as a widthwise direction.

Figure 4:
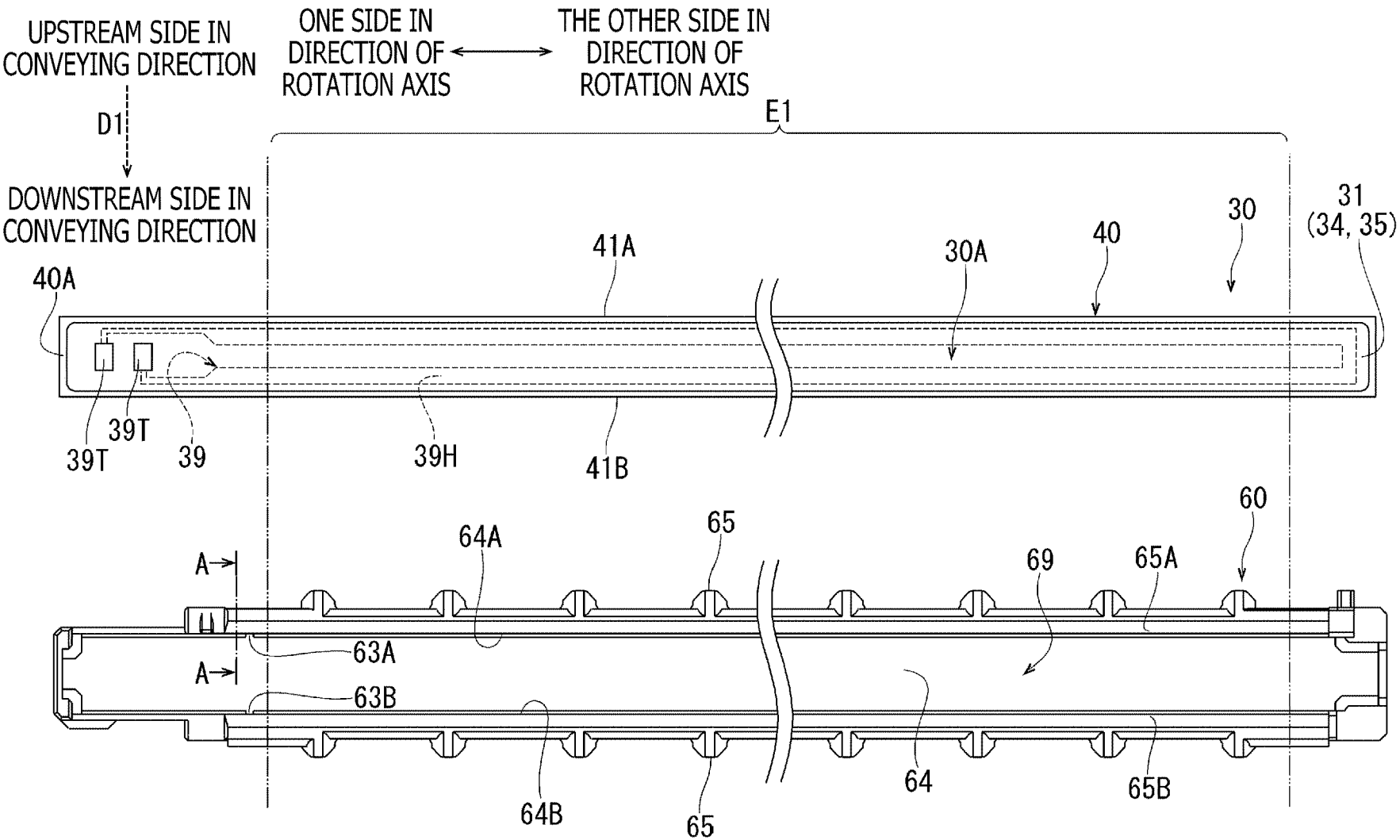
FIG. 4 shows bottom views of a heater and a holder in the fuser according to the first embodiment of the present disclosure.

As shown in FIG. 4, the heater 30 has a rectangular form having longer sides and shorter sides. In particular, a length of the sides of the heater 30 in the direction of the rotation axis X59 is greater than a length of the sides of the heater 30 in the conveying direction D1. FIG. 4 shows a sheet passage zone E1, in which a sheet SH having a maximum crosswise breadth usable in the image forming apparatus 1 may proceed when the sheet SH is conveyed in the fuser 5. The sheet passage zone E1 is a zone, in which the fuser 5 may fix an image in the developing agent onto the sheet SH being an image recording medium. In other words, the sheet passage zone E1 is a zone, through which an image in a developing agent to be fixed onto the sheet SH may pass. The length of the heater 30 in the direction of the rotation axis X59 is greater than a length of the sheet passage zone E1 in the direction of the rotation axis X59. The heater 30 will be described further below.

The belt 55 is a heat-resistant and flexible tubular member, as shown in FIGS. 2 and 3, made of a sheet of resin such as polyimide or metal such as stainless steel. Inside the belt 55, the heater 30, the holder 60, and the stay 54 are arranged. The belt 55 has an inner circumferential surface 55A that may contact the first face 30A of the heater 30.

The stay 54 may be made of a piece of rigid plate, e.g., a steel plate, by being bent in a cross-sectional form of a vertically reversed U. The stay 54 extends in the direction of the rotation axis X59 in an arrangement not contacting the inner circumferential surface 55A of the belt 55.

The holder 60 is a heat-resistant resin-made member. The holder 60 is attached to a lower part of the stay 54 and is supported by the stay 54. The holder 60 has a heater accommodative portion 69 and a belt guiding face 65.

The heater accommodative portion 69 is a portion recessed upward from a lower face of the holder 60 at a central area in the conveying direction D1 and extending in the direction of the rotation axis X59. A length between an inner side face of the heater accommodative portion 69 on an upstream side in the conveying direction D1 and an inner side face of the heater accommodative portion on a downstream side in the conveying direction D1 is slightly larger than the length of the heater 30 in the conveying direction D1.

The heater accommodative portion 69 includes a retainer face 64. The retainer face 64 is an inner and upper face, or a ceiling, of the heater accommodative portion 69 facing downward and spreading in the direction of the rotation axis X59 and the conveying direction D1. As shown in FIG. 4, a length of the retainer face 64 in the direction of the rotation axis X59 is, similarly to the heater 30, greater than the length of the sheet passage zone E1 in the direction of the rotation axis X59.

As shown in FIGS. 3 and 4, the heater accommodative portion 69 includes a pair of grooves 64A, 64B. The pair of grooves 64A, 64B are located on one end and the other end of the retainer face 64 in the widthwise direction, i.e., on an upstream side and a downstream side in the retainer face 64 in the conveying direction D1, respectively.

The pair of grooves 64A, 64B are recessed upward and elongated to thinly extend in the direction of the rotation axis 59. As shown in FIG. 4, a length of the grooves 64A, 64B is, similarly to the retainer face 64, greater than the length of the sheet passage zone E1 in the direction of the rotation axis X59.

As shown in FIG. 4, the heater accommodative portion 69 includes a pair of contact portions 63A, 63B. The pair of contact portions 63A, 63B are located outside the sheet passage zone E1, in other words, located at positions on one side of the sheet passage zone E1 in the direction of the rotation axis X59.

Figure 5:
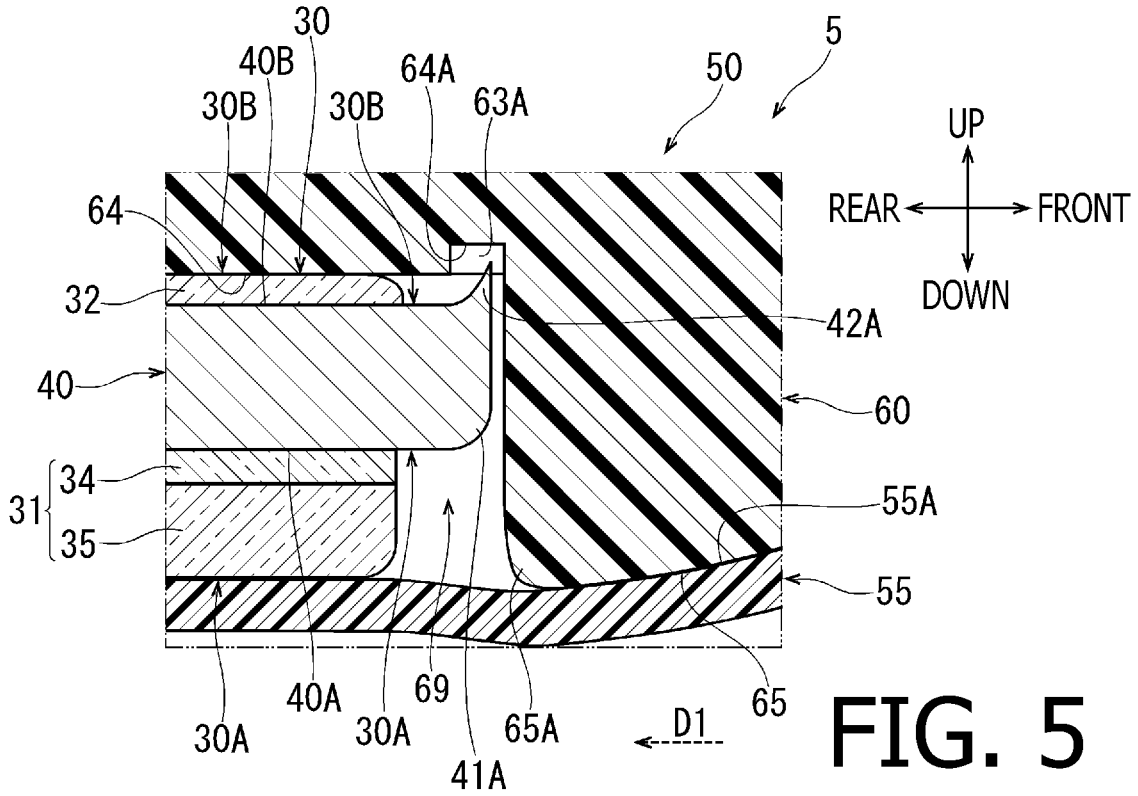
FIG. 5 is a cross-sectional view of the holder in the fuser according to the first embodiment of the present disclosure taken at a line A-A indicated in FIG. 4.

As shown in FIG. 5, the contact portion 63A, which is on the upstream side in the conveying direction D1, is formed to partly fill the groove 64A on the upstream side in the conveying direction D1. A lower face of the contact portion 63A aligns on a same plane with the retainer face 64. Although not shown in FIG. 5, the contact portion 63B, which is on the downstream side in the conveying direction D1, is formed to partly fill the groove 64B on the downstream side in the conveying direction D1, and a lower face of the contact portion 63B aligns on a same plane with the retainer face 64.

As shown in FIG. 3, the heater accommodative portion 69 accommodates the heater 30 fitted therein, with the retainer face 64 contacting the second face 30B of the heater 30, and the inner side faces of the heater accommodative portion 69 on the upstream side and the downstream side in the conveying direction D1 holding the heater 30 from the upstream side and the downstream side, respectively, to restrict the heater 30 from being displaced.

The belt-guiding face 65 is a curved face formed in the holder 60 on an upstream side and a downstream side of the heater accommodative portion 69 in the conveying direction D1. The belt-guiding face 65 includes a pair of guiding edges 65A, 65B.

The guiding edge 65A on the upstream side in the conveying direction D1 is connected to a lower end of the inner side face of the heater accommodative portion 69 on the upstream side in the conveying direction D1 and extends in the direction of the rotation axis X59. The guiding edge 65B on the downstream side in the conveying direction D1 is connected to a lower end of the inner side face of the heater accommodative portion 69 on the downstream side in the conveying direction D1 and extends in the direction of the rotation axis X59. The guiding edges 65A, 65B are rounded ridges.

The belt-guiding face 65 on the upstream side in the conveying direction D1 extends upstream from the guiding edge 65A on the upstream side in the conveying direction D1 and curves upward. The belt-guiding face 65 on the downstream side in the conveying direction D1 extends downstream from the guiding edge 65B on the downstream side in the conveying direction D1 and curves upward.

The belt-guiding face 65 contacts the inner circumferential surface 55A of the belt 55 and guide the belt 55 there-along. Thus, the belt 55 may rotate around the heater 30, the holder 60, and the stay 54.

The pressure roller 59 includes a rotation shaft 59A, which is centered at the rotation axis X59 and may be made of metal; and an elastic layer 59B, which covers the rotation shaft 59A. The pressure roller 59, in conjunction with the heater 30, nips the belt 55 at a position between the pressure roller 59 and the heater 30. In other words, the pressure roller 59 and the heater 30 form a nipping portion N1, at which the heat and the pressure may be applied to the sheet SH.

The pressure roller 59 may be driven by a driving force transmitted from a motor, which is not shown but may be arranged inside the main body 2, and rotate to apply a conveying force to the sheet SH. The belt 55 may be driven by the driving force transmitted either directly from the rotating pressure roller 59 or indirectly through the sheet SH moving in the nipping portion N1.

Thus, with the inner circumferential surface 55A of the belt 55 contacting the first face 30A of the heater 30, the belt 55 may be heated by the heater 30, rotate around the heater 30, and, in conjunction with the pressure roller 59, apply heat and pressure to the sheet SH moving in the nipping portion N1. Thereby, the image formed in the developing agent may be thermally fixed onto the sheet SH.

<Detailed Configuration of the Heater>

As shown in FIGS. 3 and 4, the heater 30 includes a base plate 40 made of metal, a resistance-heating element 39, a first glass layer 31, and a second layer 32. The resistive-heating element 39 and the first glass layer 31 are formed on the first face 30A of the heater, and the second layer 32 is formed on the second face 30B of the heater 30.

In the cross-sectional views of the heater 30, as shown in FIGS. 3 and 4, for a purpose of easier understanding, the base plate 40, the resistance-heating element 39, the first glass layer 31, and the second class layer 32 are illustrated in relatively exaggerated thickness; however, in an actually manufactured fuser 5, the resistance-heating element 39, the first glass layer 31, and the second glass layer 32 may be substantially thinner than the base plate 40.

The base plate 40 is a plate member made of metal such as, for example, stainless steel, and has a predetermined thickness. The base plate 40 includes a first plate face 40A and a second plate face 40B. The first plate face 40A is a plane facing downward and spreading in the direction of the rotation axis X59 and the conveying direction D1. The second plate face 40B is a plane facing reversely from the first plate face 40A, i.e., upward, and spreads in parallel to the first plate face 40A. The thickness of the base plate 40 may mean a dimension in the vertical direction.

As shown in FIG. 4, the base plate 40 has a rectangular shape in a plan view and forms the rectangular outline of the heater 30 by edges on one end and the other end in the direction of the rotation axis 59 and edges on an upstream end and a downstream end in the conveying direction D1.

As shown in FIG. 3, the first plate face 40A of the base plate 40 has a pair of first edges 41A, 41B. The pair of first edges 41A, 41B are located on one end and the other end of the first face 30A of the heater 30 in the widthwise direction, respectively, in other words, on an upstream end and a downstream end of the first face 30A in the conveying direction D1, respectively. The first edges 41A, 41B extend in the lengthwise direction of the heater 30, in other words, in the direction of the rotation axis X59.

The second plate face 40B of the base plate 40 has a pair of second edges 42A, 42B. The second edges 42A, 42B are located on one end and the other end of the second face 30B of the heater 30 in the widthwise direction, respectively, in other words, on an upstream end and a downstream end of the second face 30B in the conveying direction D1, respectively. The second edges 42A, 42B extend in the lengthwise direction of the heater 30, in other words, in the direction of the rotation axis X59.

The base plate 40 may be formed in pressing works using, for example, known die-and-punch tools.

While illustration of the die is omitted in the drawings, the die may be formed to have a pierced hole, which is in a form corresponding to the outline of the base plate 40. The punch may have a protrusive form protruding downward. On a lower face of the punch, a puncher head may be formed, and a cutting blade may be formed along an outer circumference of the puncher head.

The metal plate being a base material of the base plate 40 may be, for example, made of a rolled sheet of steel: the sheet of steel may be drawn out from the roll and placed on the die. The punch may descend toward the pierced hole formed in the die, and as the punch shears through the metal plate on the die with the cutting blades in the die and in the punch, the base plate 40 may be formed. When the punch shears through the metal plate, on an outer circumferential edge of the base plate 40 on the face that contacted the puncher head of the punch, burrs may be formed; and on an outer circumferential edge of the base plate 40 on the other face that did not contact the puncher head of the punch, shear drops may be formed.

In the present embodiment, the second plate face 40B is the face of the base plate 40 that contacts the puncher head of the punch, and the first plate face 40A of the base plate 40 faces reversely from the face that contacts the puncher head of the punch.

Therefore, in the pair of first edges 41A, 41B, shear drops curving toward the second face 30B in the direction of thickness of the base plate 40 are formed. The shear drops in the first edges 41A, 41B are rounded at ridges extending in the direction of the rotation axis X59.

Meanwhile, in the pair of second edges 42A, 42B, burrs protruding in the direction of thickness of the base plate 40 to point away from the first face 30A are formed. The burrs in the second edges 42A, 42B protrude to taper pointing upward and extend in the direction of the rotation axis X59.

In the cross-sectional view of the heater 30, for a purpose of easier understanding, the burrs and the shear drops are shown in relatively exaggerated sizes.

Manufacturers may consider, for example, forming the base plate 40 in etching works, in which a part of the metal plate to form the base plate 40 is masked, and the other unmasked part of the metal plate is etched by the corrosive effect of the etchant, since burrs and shear drops may less likely be formed on the outer circumferential edges of the base plate 40 in the etching works. However, manufacturing costs may increase in the etching works compared to the pressing works.

The first glass layer 31 is in a two-layered formation including an insulating layer 34 and a protective layer 35. The insulating layer 34 is formed on the first plate face 40A of the base plate 40, and the protective layer 35 is formed on the insulating layer 34 to cover the insulating layer 34.

As shown in FIG. 4, an outline of the first glass layer 31 in the plan view is smaller than the outline of the base plate 40 for, for example, 1-2 mm. Therefore, the pair of first edges 41A, 41B and peripheries thereof on the first plate face 40A are not covered with the first glass layer 31 but is exposed.

As shown in FIG. 3, the resistive-heating element 39 is formed between the insulating layer 34 and the protective layer 35. As shown in FIG. 4, the resistive-heating element 39 includes an approximately U-shaped heating pattern 39H and two (2) connector terminals 39T, which are formed on one and the other ends of the heating pattern 39H. The connector terminals 39T are located outside the sheet passage zone E1 in the direction of the rotation axis X59, in other words, on one side of the sheet passage zone E1 in the direction of the rotation axis X59.

The protective layer 35 covers the resistive-heating element 39 except the connector terminals 39T. The connector terminals 39T may contact mating terminals of a connector, which is not shown. The resistive-heating element 39, when powered through the connectors 39T, may generate heat.

As shown in FIG. 3, the second glass layer 32 is formed on the second plate face 40B of the base plate 40. An outline of the second glass layer 32 in a plan view may be substantially the same as the outline of the first glass layer 31 shown in FIG. 4 and is smaller than the outline of the base plate 40 for, for example, 1-2 mm. Therefore, the pair of second edges 42A, 42B and peripheries thereof on the second plate face 40B are not covered with the second glass layer 32 but is exposed.

The first face 30A of the heater 30 is formed of a lower face of the protective layer 35 and the exposed part of the first plate face 40A including the pair of first edges 41A, 41G and the peripheries thereof.

The second face 30B of the heater 30 is formed of an upper face of the second glass layer 32, and the exposed part of the second plate face 40B including the pair of second edges 42A, 42G and the peripheries thereof.

In the condition where the heater 30 is accommodated in the heater accommodative portion 69, the retainer face 64 contacts the upper face of the first glass layer 32, and the lower face of the protective layer 35 in the first glass layer 31 contacts the inner circumferential surface 55A of the belt 55.

In the condition where the heater 30 is accommodated in the heater accommodative portion 69, the guiding edges 65A, 65B on the belt-guiding face 65 extend in the direction of the rotation axis X59 at positions in adjacent to the first edges 41A, 41B of the base plate 40, respectively. The pair of guiding edges 65A, 65B protrude in the direction of thickness of the base plate 40 for a distance L1 from the pair of first edges 41A, 41B on a side of the pair of first edges 41A, 41B opposite to the second face 30B.

The lower face of the protective layer 35 in the first glass layer 31 is retracted in the direction of the thickness of the base plate 40 from the pair of guiding edges 65A, 65B toward the second face 30B for a distance L2.

The grooves 64A, 64B located on the upstream end and the downstream end of the retainer face 64 in the conveying direction D1 overlap the second edges 42A, 42B of the base plate 40, respectively, in the direction of thickness of the base plate 40. Although forms and sizes of the burrs that may be formed on the second edges 42A, 42B may not always be identical, pointing ends of the burrs may enter the grooves 64A, 64B, respectively.

The contact portion 63A shown in FIG. 5, which is on the upstream side in the conveying direction D1, contacts the second edge 42A on the upstream side in the conveying direction D1. The pointing end of the burr formed on the second edge 42A entering the groove 64A on the upstream side in the conveying direction D1 may wedge into the contact portion 63A.

Although not shown in FIG. 5, the contact portion 63B, which is on the downstream side in the conveying direction D1, may contact the second edge 42B on the downstream side in the conveying direction D1. The pointing end of the burr formed on the second edge 42B entering the groove 64B on the downstream side in the conveying direction D1 may wedge into the contact portion 63B.

<Benefits>

In the fuser 5 according to the first embodiment, as shown in FIG. 3, the first face 30A of the base plate 40 may contact the inner circumferential surface 55A of the belt 55. On the first face 30A, at the first edges 51A, 51B located on the upstream side and the downstream side in the conveying direction D1, shear drops curving in the direction of the thickness of the base plate 40 toward the second face 30B are formed. Therefore, in the fuser 5, it may be less likely that the inner circumferential surface 55A of the belt 55 contacting the first face 30A of the heater 30 may be damaged by the base plate 40.

Thus, the durability of the belt 55 in the fuser 5 may be improved.

Moreover, the heater 30 in the fuser 5 has the first glass layer 31, which is formed on the first face 30A of the heater 30. Meanwhile, the pair of first edges 41A, 41B are exposed without being covered. In this arrangement, the inner circumferential surface 55A of the belt 55 may contact the heater 30 mainly on the lower face of the first glass layer 31. Therefore, slidability of the belt 55 on the heater 30 may be improved. Moreover, while the pair of first edges 41A, 41B are exposed, the pair of first edges 41A, 41B forming the shear drops may be less likely to damage the inner circumferential surface 55A of the belt 55. In this regard, compared to a hypothetical configuration, in which the first glass layer 31 are extended to cover the pair of first edges 41A, 41B, a manufacturing process to form the first layer 31 in the heater 30 may be simplified.

Moreover, the resistive-heating element 39 in the fuser 5 is interposed between the insulating layer 34, which is formed on the first plate face 40A of the base plate 4, and the protective layer 35, which is formed on the insulating layer 34. In this arrangement, compared to a hypothetical configuration, in which the resistive-heating element 39 is formed on the second face 30B, the belt 55 may be heated efficiently, and the insulating ability of the resistive-heating member 39 may be improved.

Moreover, the pair of guiding edges 65A, 65B of the belt-guiding face 65 in the fuser 5 protrude in the direction of thickness of the base plate 40 for the distance L1 from the pair of first edges 41A, 41B in the direction opposite to the second face 30B. In this arrangement, the inner circumferential surface 55A of the belt 55 may be restrained from contacting the first edges 41A, 41B. Therefore, durability of the belt 55 may be improved.

Moreover, the pair of second edges 42A, 42B of the base plate 40 overlap the pair of grooves 64A, 64B located on the upstream side and the downstream side of the retainer face 64 of the holder 60 in the conveying direction D1. In this arrangement, the pointing ends of the burrs formed on the second edges 42A, 42B may not contact the retainer face 64. Therefore, the retainer face 64 of the holder 60 may retain the heater 30 closely attached thereto, without pushing the heater 30 away, at the correct position.

Moreover, the contact portion 63A shown in FIG. 5, which is on the upstream side in the conveying direction D1, contacts the second edge 42A on the upstream side in the conveying direction D1. The pointing end of the burr formed on the second edge 42A entering the groove 64A on the upstream side in the conveying direction D1 may wedge into the contact portion 63A. Meanwhile, although not shown in FIG. 5, the contact portion 63B, which is on the downstream side in the conveying direction D1, may contact the second edge 42B on the downstream side in the conveying direction D1. The pointing end of the burr formed on the second edge 42B entering the groove 64B on the downstream side in the conveying direction D1 may wedge into the contact portion 63B. In this arrangement, the heater 30 may be restrained from moving with respect to the holder 60 in the direction of the rotation axis X59.

Moreover, as shown in FIG. 4, the pair of connector terminals 39T in the fuser 5 are located outside the sheet passage zone E1 in the direction of the rotation axis X59. In this arrangement, even when, for example, the connectors 63A, 63B act to cause the heater 30 to be locally peeled off or separated from the retainer face 64, influence on the fusing ability for the fuser 5 to fuse the image in the developing agent onto the sheet SH due to the separation may be limited.

Moreover, as shown in FIG. 3, the heater 30 in the fuser 5 has the second glass layer 32 formed on the second face 30B of the heater 30. In this arrangement, the retainer face 64 of the holder 60 may be located at the position retracted from the pair of second edges 42A, 42B for the thickness of the second glass layer 32.

Moreover, in the fuser 5, the lower face of the protective layer 35 in the first glass layer 31 is located at the position retracted in the direction of thickness of the base plate 40 from the pair of guiding edges 65A, 65B toward the second face 30B for the distance L2. Therefore, the pair of first edges 41A, 41B may be separated from the inner circumferential surface 55A of the belt 55. As a result, contact between the first edges 41A, 41B and the inner circumferential surface 55A of the belt 55 may be restrained effectively, and the durability of the belt 55 may be improved further.

Second Embodiment

Figure 6:
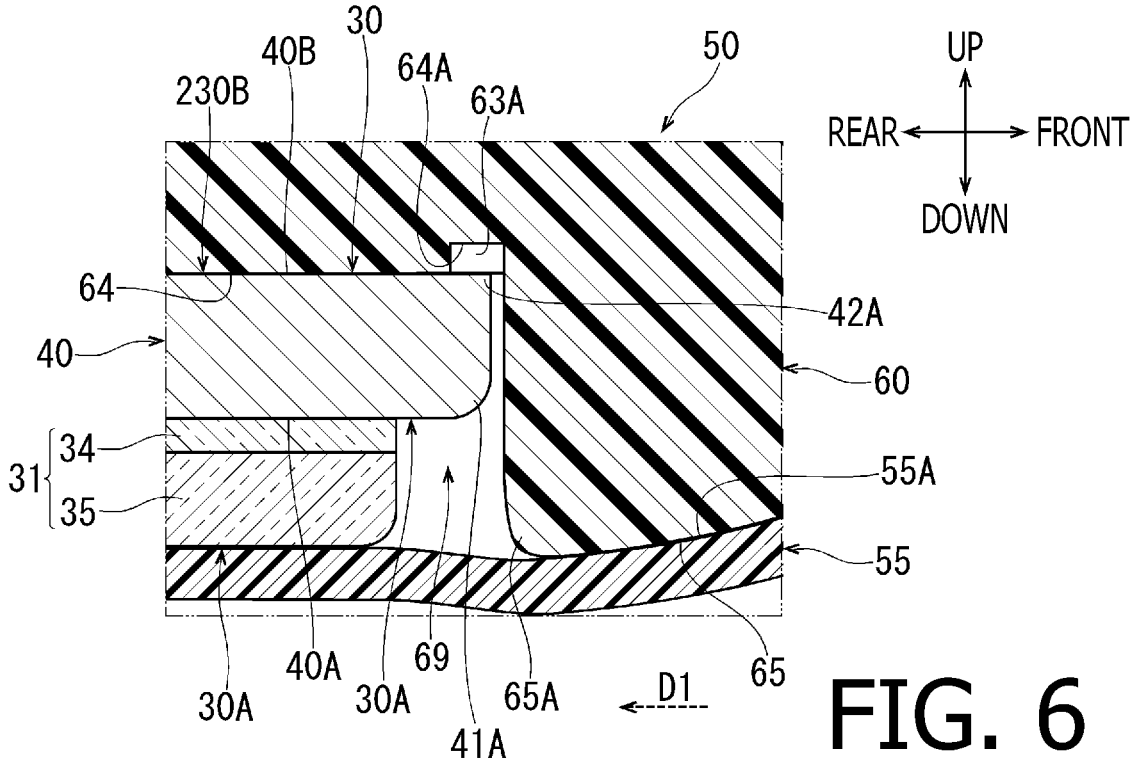
FIG. 6 is a cross-sectional view of a holder in a fuser according to a second embodiment of the present disclosure taken at a line corresponding to the line A-A indicated in FIG. 4.

As shown in FIG. 6, a fuser in the second embodiment is different from the fuser 5 in the first embodiment at least in that the heater 30 does not have the second glass layer 32. Therefore, in place of the second face 30B, the heater 30 in the fuser of the second embodiment has a second face 230B, which is formed of the second plate face 40B of the base plate 40 alone. The retainer face 64 may contact and retain the second face 230B of the heater 30.

Moreover, in the fuser in the second embodiment, the second edge 42A of the base plate 40 on the upstream side in the conveying direction D1 may form a sharp edge rather than a burr. Although not shown in FIG. 6, the second edge 42B of the base plate 40 on the downstream side in the conveying direction D1 may form a sharp edge rather than a burr as well.

The sharp edge in this context may refer to a form of a ridge, which is not rounded but is pointing. The sharp edge may be formed by, for example, removing burrs by cutting or grinding.

The groove 64A on the upstream side in the conveying direction D1 may overlap the sharp edge on the second edge 42A on the upstream side in the conveying direction D1. The contact portion 63A on the upstream side in the conveying direction may contact the sharp edge on the second edge 42A on the upstream side in the conveying direction D1.

Although not shown in FIG. 6, the contact portion 63B on the downstream side in the conveying direction D1 may contact the sharp edge on the second edge 42B on the downstream side in the conveying direction D1.

The remainder of the fuser in the second embodiment may be similar to the fuser 5 in the first embodiment. Therefore, in the following paragraphs, items or structures which are substantially the same as or similar to those described in the first embodiment may be denoted by the same reference signs, and description of those may be omitted.

In the fuser according to the second embodiment, similarly to the fuser 5 in the first embodiment, durability of the belt 55 may be improved.

Moreover, the pair of second edges 42A, 42B of the base plate 40 overlap the pair of grooves 64A, 64B located on the upstream side and the downstream side of the retainer face 64 of the holder 60 in the conveying direction D1. In this arrangement, the sharp edges formed on the second edges 42A, 42B may not contact the retainer face 64. Therefore, the retainer face 64 of the holder 60 may retain the heater 30 closely attached thereto, without pushing the heater 30 away, at the correct position.

Moreover, in the fuser of the second embodiment, with the pair of contact portions 63A, 63B being arranged to contact the sharp edges on the pair of second edges 42A, 42B, the heater 30 may be restrained from moving relatively to the holder 60 in the direction of the rotation axis X59.

Third Embodiment

Figure 7:
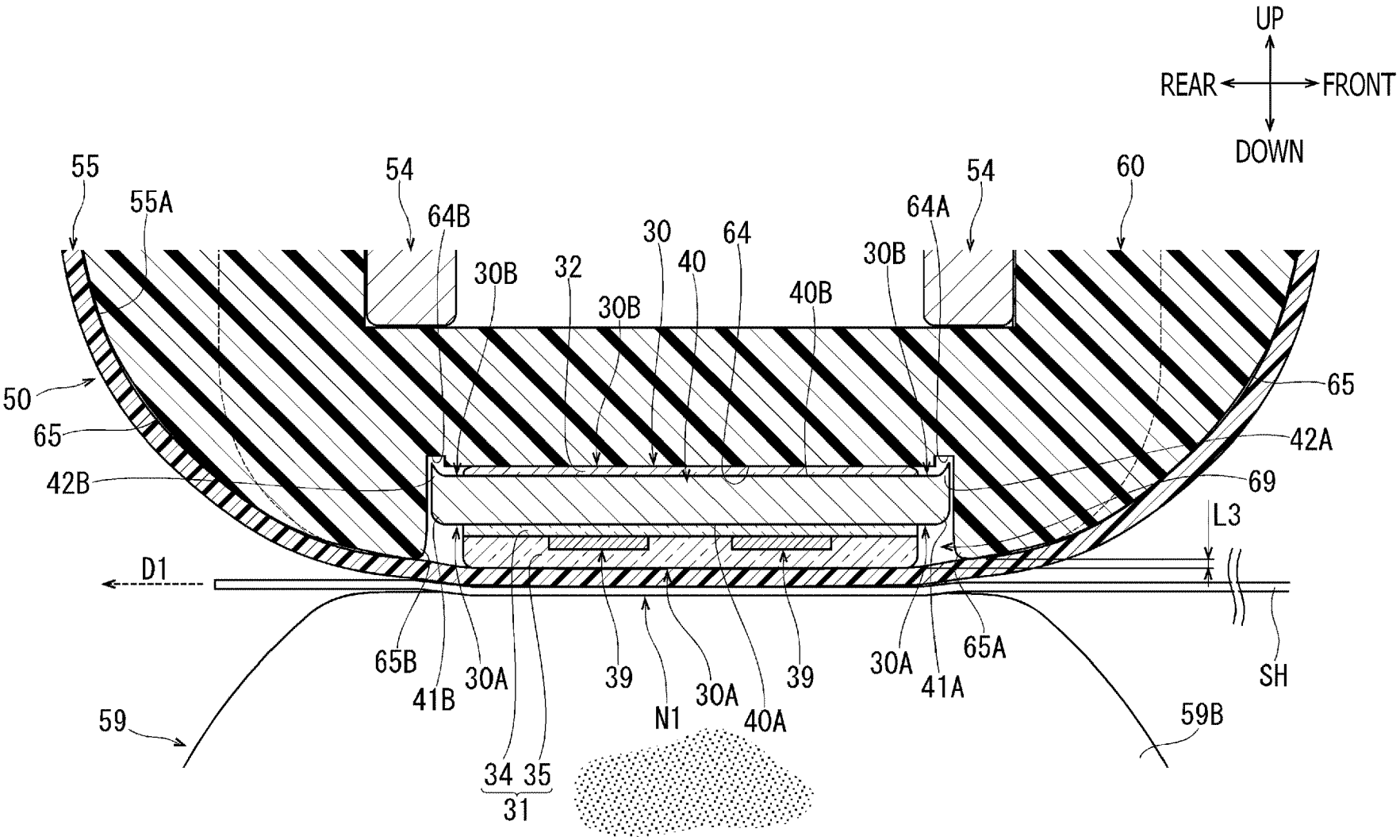
FIG. 7 is a cross-sectional partial view of a fuser according to a third embodiment of the present disclosure.

While in the fuser 5 in the first embodiment the lower face of the protective layer 35 in the first glass layer 31 is retracted in the direction of the thickness of the base plate 40 from the pair of guiding edges 65A, 65B toward the second face 30B for the distance L2, in a fuser in the third embodiment, as shown in FIG. 7, the lower face of the protective layer 35 protrudes in the direction of the thickness of the base plate 40 for a distance L3 from the pair of guiding edges 65A, 65B on a side of the guiding edges 65A, 65B opposite to the second face 30B.

The remainder of the fuser in the third embodiment may be similar to the fuser 5 in the first embodiment. Therefore, in the following paragraphs, items or structures which are substantially the same as or similar to those described in the first embodiment may be denoted by the same reference signs, and description of those may be omitted.

In the fuser according to the third embodiment, similarly to the fuser 5 in the first embodiment or the fuser in the second embodiment, durability of the belt 55 may be improved.

Moreover, in the fuser of the third embodiment, the lower face of the protective layer 35 in the first glass layer 31 protrudes in the direction of the thickness of the base plate 40 for the distance L3 from the pair of guiding edges 65A, 65B on the side of the guiding edges 65A, 65B opposite to the second face 30B. In this arrangement, the pair of guiding edges 65A, 65B may be restrained from affecting the contacting condition between the first glass layer 31 and the inner circumferential surface 55A of the belt 55. Therefore, slidability of the belt 55 on the heater 30 may be improved.

Although examples of carrying out the invention have been described, those skilled in the art will appreciate that there are numerous variations and permutations of the fuser that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the base plate 40 may not necessarily be formed in the pressing works but may be formed in, for example, laser-cutting works. When the base plate is formed in the laser-cutting works, shear drops may be formed on a face, at which the laser beam is emitted. Therefore, the base plate may be set in an arrangement such that the face, at which the laser beam was emitted, should face the first face of the heater. For another example, the base plate may be formed in cutting works, and shear drops in the pair of first edges of the base plate may be formed by cutting works as well.

For another example, the base plate 40 may not be a plane or flat plate but may be curved to have a cross-sectional shape of an arc that curves orthogonally to the lengthwise direction.

For another example, at least one of the pair of contact portions 63A, 63B may be omitted.

For another example, the resistive-heating element 39 may not necessarily be formed on the first face 30A of the heater 30 but may be formed on the second face 30B or may be formed on both the first face 30A and the second face 30B of the heater 30.

For another example, the thickness of the second glass layer 32 may not necessarily be so large as to allow the pointing ends of the burrs formed on the second edges 42A, 42B to enter the grooves 64A, 64B, respectively, as shown in FIG. 5, but may be larger than the length of the burrs formed on the second edges 42A, 42B in the direction of thickness of the base plate 40. If the thickness of the second glass layer 32 is larger than the length of the burrs formed on the second edges 42A, 42B in the direction of thickness of the base plate 40, the retainer face 64 of the holder 60 may retract securely from the second edges 42A, 42B having the burrs. Therefore, while the burrs on the second edges 42A, 42B may not enter the grooves 64A, 64B, the grooves 64A, 64B may be omitted.

The fuser in the present disclosure may be applicable to, for example, an image forming apparatus and a multifunction peripheral machine.

What is claimed is:

1. A fuser comprising:

a heater including a metal-made base plate and a resistive-heating element, the heater having a first face extending in a lengthwise direction and a widthwise direction and a second face facing reversely from the first face, the resistive-heating element being formed on at least one of the first face and the second face;

a belt being an endless belt having an inner circumferential surface, the inner circumferential surface being in contact with the first face of the heater, the belt being configured to rotate around the heater; and a holder having a retainer face configured to contact the second face of the heater to retain the heater and a belt-guiding face configured to contact the inner circumferential surface of the belt and guide the belt there-along, wherein the base plate has a pair of first edges located on one end and the other end of the first face in the widthwise direction, the pair of first edges being rounded at ridges extending in the lengthwise direction, wherein the base plate has a pair of second edges located on one end and the other end of the second face in the widthwise direction, the pair of second edges extending in the lengthwise direction, and wherein the holder has a pair of grooves located on one side and the other side on the retainer face in the widthwise direction, the pair of grooves extending in the lengthwise direction and overlapping the pair of second edges in the direction of thickness of the base plate.

2. The fuser according to claim 1, wherein the heater has a first-side glass layer formed on the first face thereof.

3. The fuser according to claim 2, wherein the pair of first edges are not covered with the first-side glass layer but are exposed.

4. The fuser according to claim 2, wherein the first-side glass layer includes an insulating layer formed on the base plate and a protective layer formed on the insulating layer, and wherein the resistive-heating element is formed between the insulating layer and the protective layer.

5. The fuser according to claim 2, wherein the belt-guiding face has a pair of guiding edges, one and the other of which extend in the lengthwise direction at positions adjacent to one and the other of the pair of first edges, respectively, and wherein the pair of guiding edges protrude in a direction of thickness of the base plate from the pair of first edges on a side of the pair of first edges opposite to the second face.

6. The fuser according to claim 5, wherein the firstfirst-side glass layer is retracted in the direction of thickness of the base plate from the pair of guiding edges on a side of the pair of guiding edges toward the second face.

7. The fuser according to claim 5, wherein the firstfirst-side glass layer protrudes in the direction of thickness of the base plate from the pair of guiding edges on a side of the pair of guiding edges opposite to the second face.

8. The fuser according to claim 1, wherein each of the pair of second edges forms a protrusion protruding in the direction of thickness of the base plate pointing away from the first face and extending in the lengthwise direction, and wherein the holder has a contact portion formed to partly fill the pair of grooves, the contact portion being configured to contact at least one of the pair of second edges.

9. The fuser according to claim 1, wherein each of the pair of second edges forms a sharp edge, and wherein the holder has a contact portion being configured to contact at least one of the pair of second edges.

10. The fuser according to claim 8, wherein the contact portion is located outside a zone, through which an image in a developing agent to be fixed onto an image recording medium passes, in the lengthwise direction.

11. The fuser according to claim 9, wherein the contact portion is located outside a zone, through which an image in a developing agent to be fixed onto an image recording medium passes, in the lengthwise direction.

12. The fuser according to claim 1, wherein the heater has a second-side glass layer formed on the second face of the heater.

13. A fuser comprising:

a heater including a metal-made base plate and a resistive-heating element, the heater having a first face extending in a lengthwise direction and a widthwise direction and a second face facing reversely from the first face, the resistive-heating element being formed on at least one of the first face and the second face;

a belt being an endless belt having an inner circumferential surface, the inner circumferential surface being in contact with the first face of the heater, the belt being configured to rotate around the heater; and a holder having a retainer face configured to contact the second face of the heater to retain the heater and a belt-guiding face configured to contact the inner circumferential surface of the belt and guide the belt there-along, wherein the base plate has a pair of first edges located on one end and the other end of the first face in the widthwise direction, the pair of first edges being rounded at ridges extending in the lengthwise direction, and wherein the heater has a second-side glass layer formed on the second face of the heater.

* * * * *